US010787758B2

(12) United States Patent
Ishikawa et al.

(10) Patent No.: US 10,787,758 B2
(45) Date of Patent: Sep. 29, 2020

(54) NEEDLE PLATE DETACHABLE MECHANISM AND SEWING MACHINE HAVING NEEDLE PLATE DETACHABLE MECHANISM

(71) Applicant: JANOME SEWING MACHINE CO., LTD., Hachioji-shi, Tokyo (JP)

(72) Inventors: Saki Ishikawa, Hachioji (JP); Koji Maeda, Hachioji (JP)

(73) Assignee: JANOME SEWING MACHINE CO., LTD., Hachioji-shi, Tokyo (JP)

( * ) Notice: Subject to any disclaimer, the term of this patent is extended or adjusted under 35 U.S.C. 154(b) by 34 days.

(21) Appl. No.: 16/296,239

(22) Filed: Mar. 8, 2019

(65) Prior Publication Data

US 2019/0352826 A1 Nov. 21, 2019

(30) Foreign Application Priority Data

May 18, 2018 (JP) ..... 2018-96050

(51) Int. Cl.
*D05B 73/12* (2006.01)
*D05B 73/00* (2006.01)

(52) U.S. Cl.
CPC ..... *D05B 73/12* (2013.01); *D05B 73/005* (2013.01)

(58) Field of Classification Search
CPC ..... D05B 73/12; D05B 73/005
See application file for complete search history.

(56) References Cited

U.S. PATENT DOCUMENTS 5,337,686 A * 8/1994 Nagata ..... D05B 73/12 112/162
2010/0175601 A1* 7/2010 Fukao ..... D05B 73/12 112/260
2011/0297063 A1* 12/2011 Fukao ..... D05B 73/12 112/260
2016/0040342 A1* 2/2016 Maeda ..... D05B 73/12 112/260
2018/0245256 A1* 8/2018 Capt ..... D05B 27/22
2019/0352825 A1* 11/2019 Yanagisawa ..... D05B 73/005
2019/0352827 A1* 11/2019 Ishikawa ..... F16B 1/00

FOREIGN PATENT DOCUMENTS

JP 2013-048846 A 3/2013
JP 2016-036570 A 3/2016
JP 2019198558 A * 11/2019 ..... D05B 73/005
TW 2016-06157 A 2/2016

* cited by examiner

*Primary Examiner* — Danny Worrell
(74) *Attorney, Agent, or Firm* — Yokoi & Co., U.S.A.; Toshiyuki Yokoi

(57) ABSTRACT

In order to prevent a replacement of the needle plate in the situation not suitable for replacing the needle plate, a needle plate detachable mechanism has a needle plate fixing unit capable of being switched between a fixed state where a needle plate is fixed to a sewing machine body and an unfixed state where the fixed state is released; and a switching mechanism which is connected with the needle plate fixing unit for switching the needle plate fixing unit between the fixed state and the unfixed state, wherein the needle plate fixing unit is prevented from being switched when the needle is positioned below an upper surface of the needle plate or when the sewing machine motor is driven.

5 Claims, 7 Drawing Sheets

NEEDLE PLATE DETACHABLE MECHANISM AND SEWING MACHINE HAVING NEEDLE PLATE DETACHABLE MECHANISM

CROSS-REFERENCES TO RELATED APPLICATIONS

This patent specification is based on Japanese patent application, No. 2018-96050 filed on May 18, 2018 in the Japan Patent Office, the entire contents of which are incorporated by reference herein.

BACKGROUND OF THE INVENTION

1. Field of the Invention

The present invention relates to a needle plate detachable mechanism and a sewing machine having the needle plate detachable mechanism.

2. Description of the Related Art

Patent documents 1 and 2 below disclose a needle plate detachable mechanism of a sewing machine. In the needle plate detachable mechanism, a needle plate is fixed to a bed part of the sewing machine when a plate spring provided on the needle plate is engaged with an engaging member of a sewing machine body. In addition, the needle plate detachable mechanism has a release lever which is manually operable and a push-up bar which is arranged between the release lever and the needle plate. The engaged state between the plate spring and the engaging member is released by manually operating the release lever to push up the needle plate via the push-up bar. Consequently, the needle plate is detached from the sewing machine body. Thus, the needle plate can be replaced.

[Patent document 1] Japanese Unexamined Patent Application Publication No. 2013-48846

[Patent document 2] Japanese Unexamined Patent Application Publication No. 2016-36570

BRIEF SUMMARY OF THE INVENTION

In the sewing machine, when a needle descends from a top dead center to a bottom dead center, the needle passes through a needle hole of the needle plate. In Patent documents 1 and 2, the release lever or the lock mechanism can be operated regardless of a vertical position of the needle. Namely, in Patent documents 1 and 2, if the release lever or the lock mechanism is operated when the needle is located at the bottom dead center, for example, a fixed state of the needle plate is released in a state that the needle passes through the needle hole. In this state, the needle plate cannot be detached from the needle since the needle passes through the needle hole although the fixed state of the needle plate is released. The above described situation is not suitable for replacing the needle plate.

In addition, when a sewing machine motor is driven, an operator sews sewing objects. In such situation, the operator has no intention to replace the needle plate. Thus, the above described situation is also not suitable for replacing the needle plate.

As explained above, it is preferable to adapt the structure of preventing the replacement of the needle plate in the situation not suitable for replacing the needle plate.

Considering the above described fact, the present invention provides a needle plate detachable mechanism capable of preventing the replacement of the needle plate in the situation not suitable for replacing the needle plate and a sewing machine having the needle plate detachable mechanism.

One or more embodiments of the present invention relate to a needle plate detachable mechanism of a sewing machine which forms a seam by vertically driving a needle by a driving force of a sewing machine motor, having: a needle plate fixing unit capable of being switched between a fixed state where a needle plate is fixed to a sewing machine body and an unfixed state where the fixed state is released; and a switching mechanism which is connected with the needle plate fixing unit for switching the needle plate fixing unit between the fixed state and the unfixed state, wherein the needle plate fixing unit is prevented from being switched when the needle is positioned below an upper surface of the needle plate or when the sewing machine motor is driven.

One or more embodiments of the present invention relate to the needle plate detachable mechanism characterized in that the needle plate fixing unit includes: a rotary unit provided on the lower surface of the needle plate; and a needle plate engaging unit provided to be integrally rotatable with the rotary unit, wherein when the rotary unit is rotated, the needle plate engaging unit is rotated between an engaged position where the needle plate engaging unit is engaged with the needle plate and a disengaged position where the needle plate engaging unit is disengaged from the needle plate, and the needle plate fixing unit is switched between the fixed state and the unfixed state when the needle plate engaging unit is rotated between the engaged position and the disengaged position One or more embodiments of the present invention relate to the needle plate detachable mechanism characterized in that the needle plate engaging unit includes: a hook portion which is engaged with the needle plate at the engaged position; and a push-up portion which pushes up the needle plate with respect to the sewing machine body at the disengaged position.

One or more embodiments of the present invention relate to the needle plate detachable mechanism characterized in that the switching mechanism includes a driving unit which is connected with the rotary unit for rotatably driving the rotary unit.

One or more embodiments of the present invention relate to a sewing machine having the above described needle plate detachable mechanism.

One or more embodiments of the present invention relate to the needle plate detachable mechanism having a detector for detecting a vertical position of the needle, wherein the switching mechanism is operated interlockingly with the detector to prevent the needle plate fixing unit of the switching mechanism from being switched from the fixed state to the unfixed state when the needle is positioned below an upper surface of the needle plate.

By adopting the needle plate detachable mechanism and the sewing machine having the above described configuration, the replacement of the needle plate can be prevented in the situation not suitable for replacing the needle plate.

DETAILED DESCRIPTION OF THE INVENTION

Figure 1:
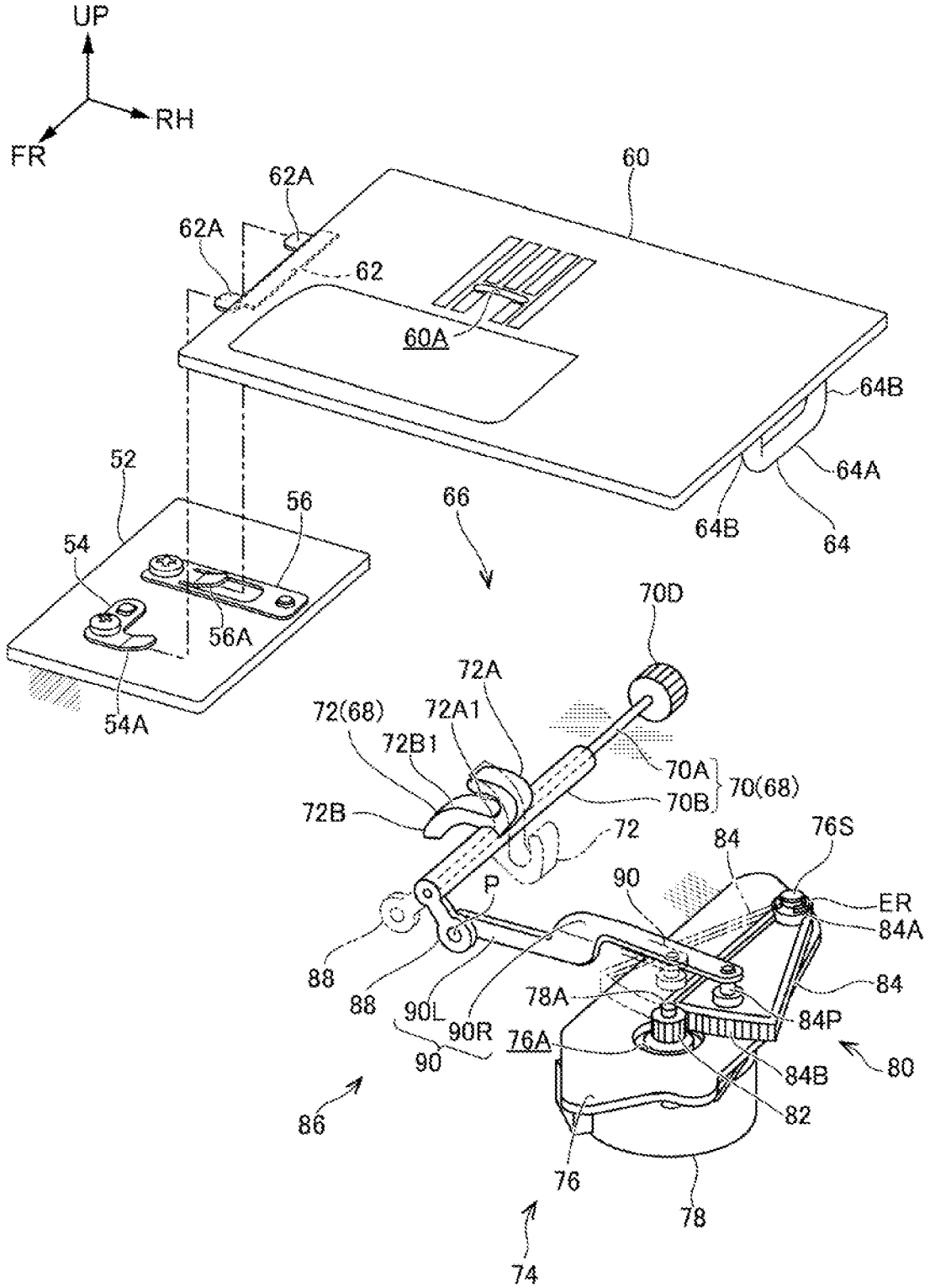
FIG. 1 is an exploded perspective view of a needle plate detachable mechanism of the present embodiment.

Hereafter, with reference to the drawings, a sewing machine 10 to which a needle plate detachable mechanism 66 of the present embodiment is applied will be explained. In the arrow marks shown in the drawings, the arrow mark UP indicates upward, the arrow mark FR indicates frontward, and the arrow mark RH indicates rightward (one of the width direction) of the sewing machine 10. Hereafter, when front-rear, up-down and left-right directions are used in the explanation, the directions indicate the front-rear, up-down and left-right directions of the sewing machine 10 unless otherwise defined.

(Entire Constitution of Sewing Machine)

Figure 2:
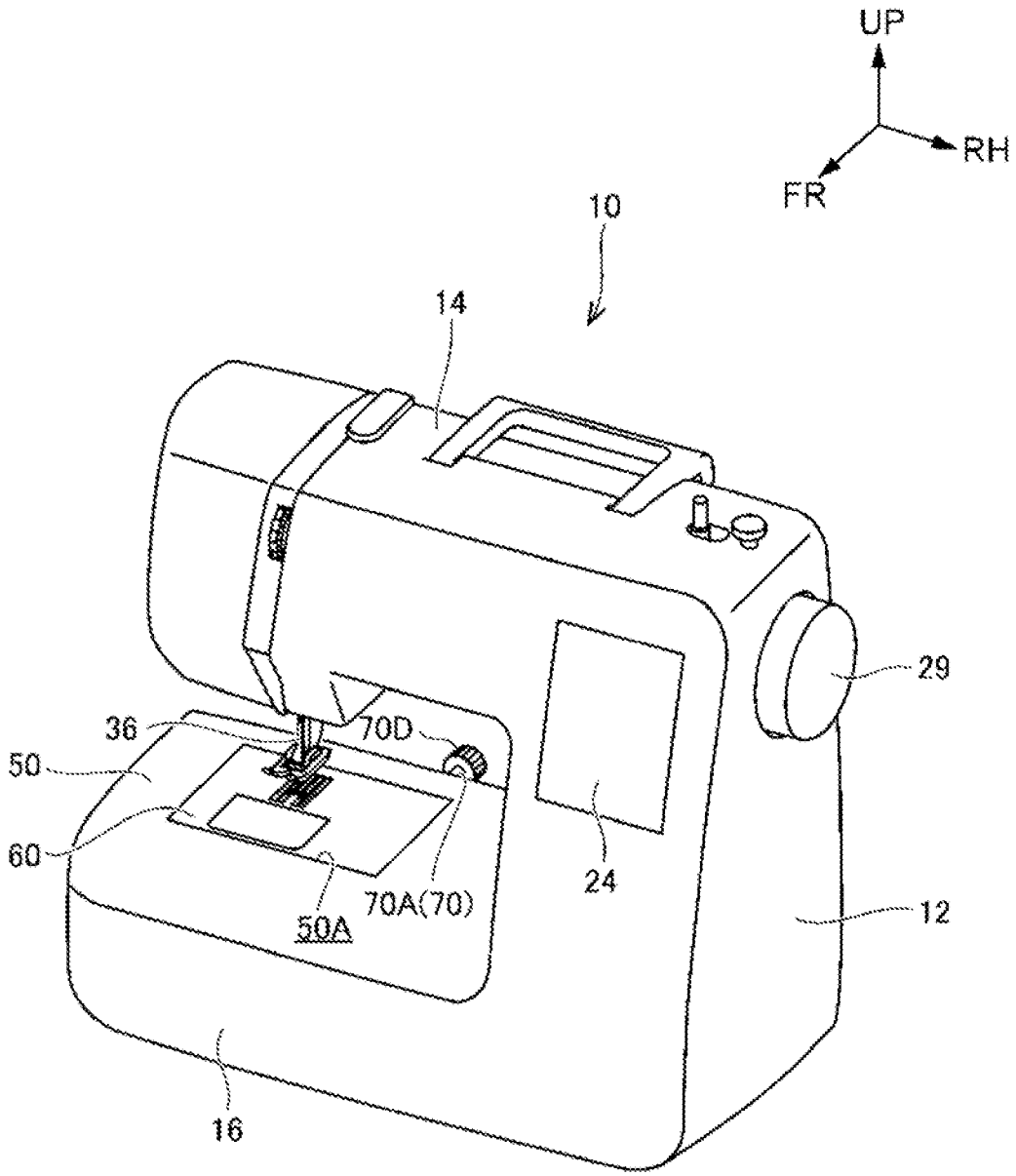
FIG. 2 is a perspective view of an entire sewing machine to which the needle plate detachable mechanism of the present embodiment is applied, viewed obliquely from the front right.

As shown in FIG. 2, the sewing machine 10 as a whole has an approximately U-shape opened to the left side in a front view when viewed from the front. Specifically, the sewing machine 10 includes a post part 12 which is vertically extended to form the right end of the sewing machine 10, an arm part 14 which is extended to the left from the upper end of the post part 12, and a bed part 16 which is extended to the left from the lower end of the post part 12 to serve as "sewing machine body." In addition, a skeleton frame (not shown in the figure) forming a frame of the sewing machine 10 is provided inside the sewing machine 10.

In addition, the sewing machine 10 has a needle plate 60 which is provided on an upper part of the left side of the bed part 16. Furthermore, the sewing machine 10 has a needle plate detachable mechanism 66 (shown in FIG. 1) for detachably fixing the needle plate 60 and a needle drive mechanism 20 (shown in FIG. 3) for vertically driving a needle 36. Hereafter, configurations of the sewing machine 10 will be explained.

(About Needle Drive Mechanism)

Figure 3:
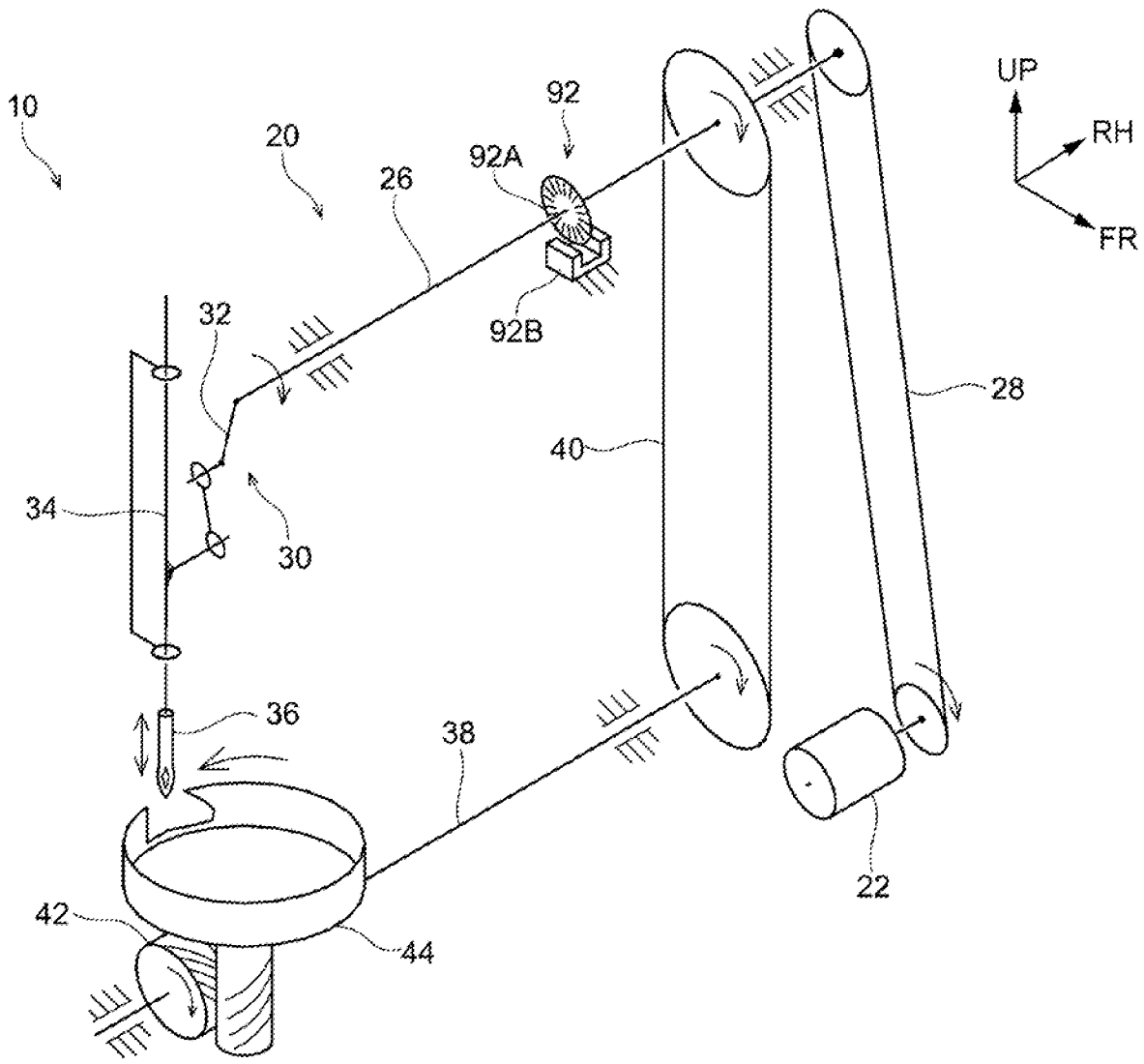
FIG. 3 is a schematic diagram schematically showing a drive mechanism of the sewing machine shown in FIG. 2.
Figure 4A:
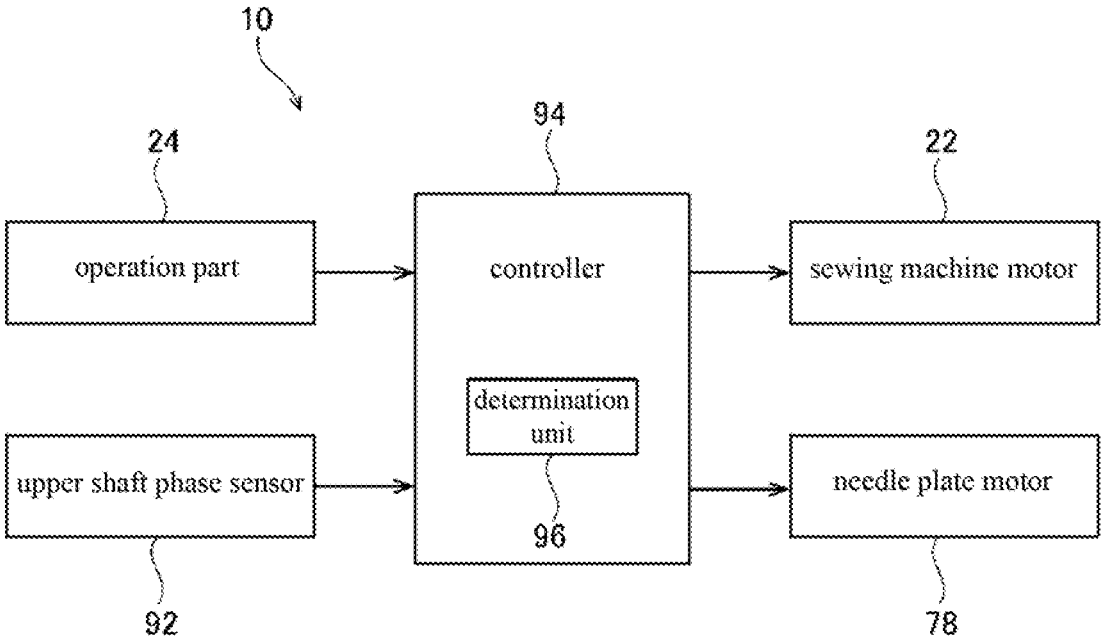
FIG. 4A is a block diagram of the sewing machine shown in FIG. 2.

As shown in FIG. 3, the needle drive mechanism 20 includes a sewing machine motor 22, an upper shaft 26, a connection mechanism 30, a needle bar 34 and a lower shaft 38. The sewing machine motor 22 is fixed to the skeleton frame so that the axial direction of the sewing machine motor 22 is aligned with the left-right direction. As shown in FIG. 4A, the sewing machine motor 22 is electrically connected with a controller 94 which will be explained later. An operation part 24 is electrically connected with the controller 94. As shown in FIG. 2, the operation part 24 is provided on the front part of the sewing machine 10 (post part 12) so as to be operable. The operation part 24 includes a display part and a touch panel. When an operator touches icons displayed on the operation part 24, operation signals of the sewing machine motor 22 and the later described needle plate motor 78 are outputted from the operation part 24 to the controller 94.

As shown in FIG. 3, the upper shaft 26 is rotatably supported by the skeleton frame in the arm part 14 (not shown in FIG. 3) so that the axial direction of the upper shaft 26 is aligned with the left-right direction. In addition, a belt 28 is laid between the right end of the upper shaft 26 and an output shaft of the sewing machine motor 22. Thus, rotative force of the sewing machine motor 22 is transferred to the upper shaft 26. Consequently, when the sewing machine motor 22 is driven, the upper shaft 26 is rotated around its axis. In addition, a flywheel 29 (shown in FIG. 2) is connected with the right end of the upper shaft 26. The flywheel 29 is arranged on the right side of the post part 12 of the sewing machine 10 and exposed outside the sewing machine 10 to be operable. When an operator rotationally operates the flywheel 29, the sewing machine 10 (upper shaft 26) can be manually driven. In addition, a crank rod 32 which forms the connection mechanism 30 is connected with the left end of the upper shaft 26.

The needle bar 34 is arranged on the left side of the connection mechanism 30 so that the axial direction of the needle bar 34 is aligned with the up-down direction. The crank rod 32 of the connection mechanism 30 is connected with the needle bar 34. When the upper shaft 26 is rotated, the needle bar 34 moves vertically. In addition, the needle 36 for sewing the sewing objects is detachably fixed to the lower end of the needle bar 34. According to the vertical movement of the needle bar 34, the needle 36 is moved vertically. Namely, the vertical position of the needle 36 is determined corresponding to the rotation angle of the upper shaft 26.

Figure 4B:
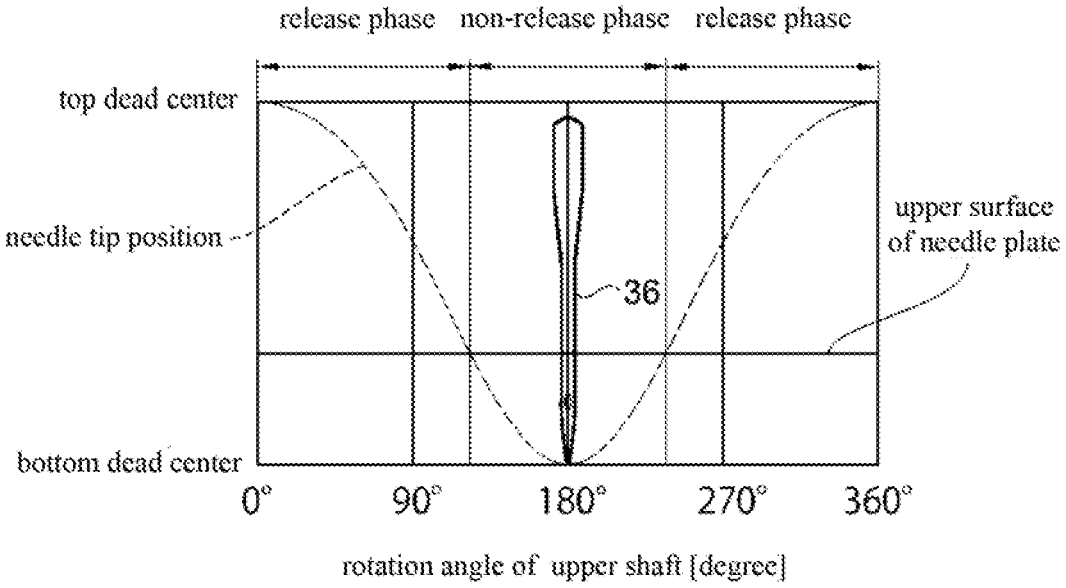
FIG. 4B is a graph showing a vertical position of a needle corresponding to a rotation angle of an upper shaft.

Specifically, as shown in FIG. 4B, the needle 36 moves vertically between the top dead center and the bottom dead center. In addition, the needle plate 60 which will be explained later is arranged between the top dead center and the bottom dead center of the needle 36. Consequently, the sewing objects are sewn by pricking the sewing objects with the needle 36 so that the needle 36 passes through a needle hole 60A formed in the needle plate 60. In the explanation below, during one cycle of the vertical movement of the needle 36, the phase of the upper shaft 26 is referred to as "release phase" when a needle tip (lower end) of the needle 36 is positioned above the upper surface of the needle plate 60, and the phase of the upper shaft 26 is referred to as "non-release phase" when the needle tip (lower end) of the needle 36 is positioned below the upper surface of the needle plate 60.

As shown in FIG. 3, the lower shaft 38 is rotatably supported by the skeleton frame in the bed part 16 (not shown in FIG. 3) so that the axial direction of the lower shaft 38 is aligned with the left-right direction. In addition, a belt 40 is laid between the right end of the lower shaft 38 and the right end of the upper shaft 26. Thus, the lower shaft 38 is rotated interlockingly with the upper shaft 26. In addition, a hook 44 is connected to the left end of the lower shaft 38 via a gear mechanism 42. When the lower shaft 38 is rotated, the hook 44 is rotated so that the axial direction of the hook 44 is aligned with the up-down direction.

(About Bed Part)

As shown in FIG. 2, the bed part 16 includes a cover 50 which forms an outer shell of the bed part 16. The skeleton frame is covered with the cover 50. In addition, a hole portion 50A is penetratingly formed on the upper wall of the cover 50 for placing the needle plate 60 which will be explained later. The hole portion 50A is formed in an approximately rectangular shape so that the longitudinal direction is aligned with the left-right direction when viewed from above.

As shown in FIG. 1, a fixing plate 52 is provided in the bed part 16 at the left side of the hole portion 50A of the cover 50 (not shown in FIG. 1). The fixing plate 52 is formed in an approximately rectangular plate shape so that the plate thickness direction is aligned with the up-down direction. The fixing plate 52 is connected and fixed to the skeleton frame. A first pressing member 54 having a plate shape and a second pressing member 56 having a plate shape are provided on the upper surface of the fixing plate 52 to fix the needle plate 60 which will be explained later. The first pressing member 54 and the second pressing member 56 are an element realized as "pressing member" in a broad sense. The first pressing member 54 and the second pressing member 56 are arranged in the front-rear direction so that the plate thickness direction is aligned in the up-down direction. The first pressing member 54 and the second pressing member 56 are fixed to the fixing plate 52 by screws. A pressing piece 54A is integrally formed with the first pressing member 54. The pressing piece 54A is inclined upward (direction separating from the fixing plate 52) toward the right side. In addition, a pressing piece 56A which is configured same as the pressing piece 54A is integrally formed with the second pressing member 56. The pressing piece 56A is inclined upward (direction separating from the fixing plate 52) toward the right side.

(About Needle Plate)

The needle plate 60 is formed in an approximately rectangular shape and arranged in the hole portion 50A of the cover 50 so that the plate thickness direction is aligned with the up-down direction (shown in FIG. 2). A locking member 62 is provided on the lower surface of the left end (one end in the longitudinal direction) of the needle plate 60. The locking member 62 has an approximately long plate shape extending in the front-rear direction. The locking member 62 is fixed to the needle plate 60 by screws. A pair of front and rear locking pieces 62A is integrally formed with both ends in the longitudinal direction of the locking member 62. The locking pieces 62A are bent in an approximately crank shape from the left end of the locking member 62 to the left and below. The tip portions of the locking pieces 62A are inserted into a space between the fixing plate 52 and the pressing piece 54A of the first pressing member 54 and a space between the fixing plate 52 and the pressing piece 56A of the second pressing member 56 from the right side. Thus, locking pieces 62A are fixed to the pressing piece 54A and the pressing piece 56A. Consequently, the left end of the needle plate 60 is fixed to the fixing plate 52 via the locking member 62.

In addition, a striker 64 is provide on the lower surface of the right end of the needle plate 60. The striker 64 is an element realized as "engaged portion" in a broad sense. The striker 64 is a bar material having a circular cross-section. The striker 64 is bent in an approximately U-shape opened to the upper side when viewed from the left-right direction. Specifically, the striker 64 includes a body portion 64A which extends in the front-rear direction and a pair of front and rear mounting portions 64B which extend upward from both ends in the longitudinal direction of the body portion 64A. The upper end of the mounting portions 64B is fixed to the lower surface of the needle plate 60.

In addition, the needle hole 60A is penetratingly formed on the needle plate 60. When the sewing objects are sewn by the sewing machine 10, the needle 36 penetrates through the needle hole 60A.

(About Needle Plate Detachable Mechanism)

Next, the needle plate detachable mechanism 66, which is an important part of the present invention, will be explained. As shown in FIG. 1, the needle plate detachable mechanism 66 includes a needle plate fixing unit 68 capable of being switched between a fixed state where the needle plate 60 is fixed to the bed part 16 and an unfixed state where the fixed state is released, a switching mechanism 74 for switching the state of the needle plate fixing unit 68, an upper shaft phase sensor 92 and a controller 94 (shown in FIG. 4A). The upper shaft phase sensor 92 is an element realized as "detector" in a broad sense.

<About Needle Plate Fixing Unit>

Figure 6A:
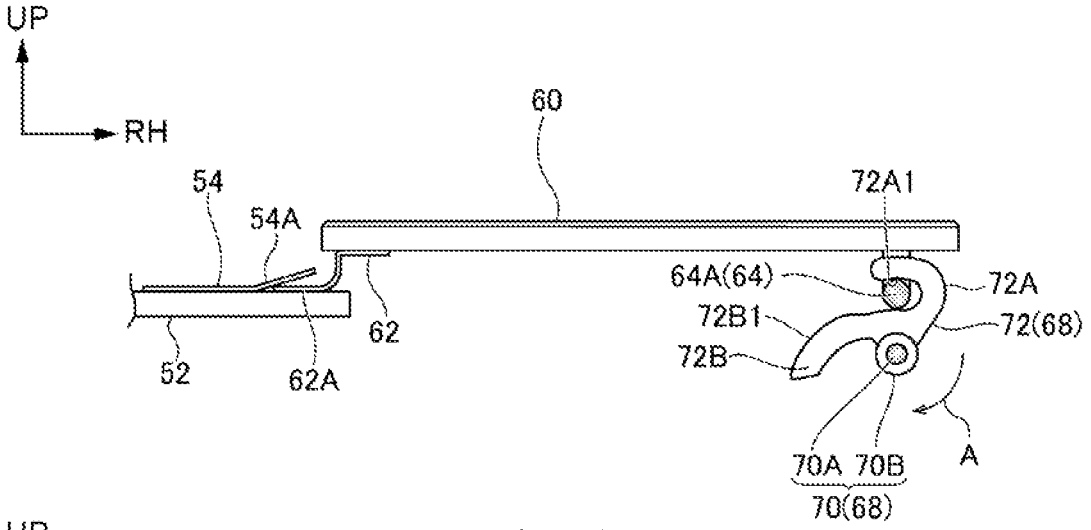
FIG. 6A is a front view showing the state where the needle plate fixing unit shown in FIG. 1 is arranged in the engaged position, viewed from the front.
Figure 6B:
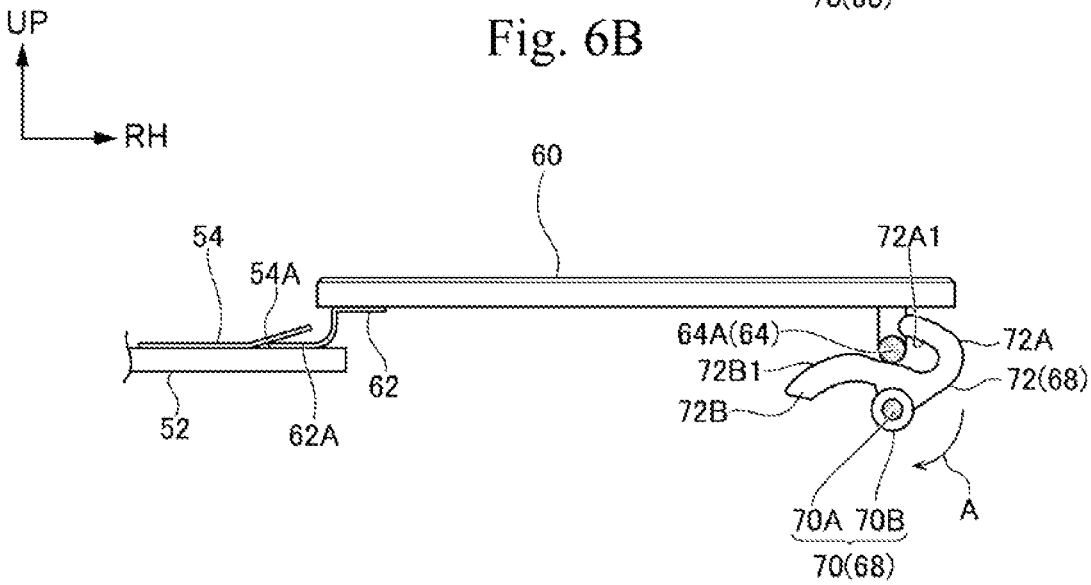
FIG. 6B is a front view showing a state where the needle plate fixing unit is rotated from the state shown in FIG. 6A to a release position.
Figure 6C:
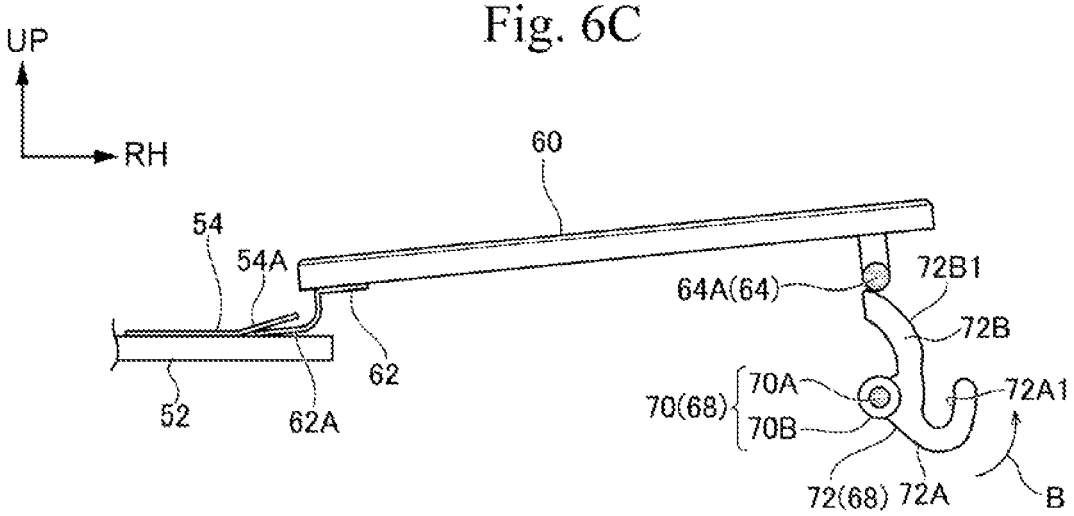
FIG. 6C is a front view showing a state where the needle plate fixing unit is rotated from the state shown in FIG. 6B to a push-up position.

As also shown in FIGS. 6A-6C, the needle plate fixing unit 68 includes a rotary shaft 70 which functions as "rotary unit" and a cam hook 72 which is integrally formed with the rotary shaft 70 to function as "needle plate engaging unit." The rotary shaft 70 is arranged below the right end of the needle plate 60 so that the axial direction of the rotary shaft 70 is aligned with the front-rear direction. Specifically, the rotary shaft 70 is separately arranged immediately below the body portion 64A of the striker 64 of the needle plate 60.

The rotary shaft 70 includes a core portion 70A having a circular cross-section to form an axial center of the rotary shaft 70 and an outer shaft portion 70B having an approximately cylindrical shape formed on an outer periphery of the core portion 70A. In the present embodiment, the core portion 70A is made of metal and the outer shaft portion 70B is made of resin (e.g., POM: polyoxymethylene). The core portion 70A and the outer shaft portion 70B are integrally formed by insert molding, for example. Specifically, the outer shaft portion 70B is integrally formed with the core portion 70A to cover the front side (one side in the axial direction) of the core portion 70A. Consequently, the rear end side of the core portion 70A is projected rearward compared to the outer shaft portion 70B. The rear end side of the core portion 70A is rotatably supported by the skeleton frame. In addition, the rear end of the core portion 70A is projected rearward compared to the cover 50 (shown in FIG. 2).

In addition, an operation dial 70D is provided on the rear end of the rotary shaft 70 (core portion 70A) so as to be integrally rotated with the rotary shaft 70. The operation dial 70D is formed in an approximately disk shape so that the axial direction of the operation dial 70D is aligned with the front-rear direction. The rear end of the rotary shaft 70 is fixed to an axial center of the operation dial 70D. Consequently, the operation dial 70D is arranged on the outer side (for detail, rear side) of the cover 50 so as to be operable (shown in FIG. 2). When the operator rotates the operation dial 70D, the rotary shaft 70 can be manually rotated.

The cam hook 72 is integrally provided on an intermediate portion in the longitudinal direction of the outer shaft portion 70B. The cam hook 72 is formed in an approximately inverse J shape opened to the left side when viewed from the front side and connected with the upper part of the outer shaft portion 70B. Specifically, the cam hook 72 includes a hook portion 72A which forms the right part of the cam hook 72 and a cam portion 72B which forms the left part of the cam hook 72 to function as "push-up portion."

The hook portion 72A is formed in an approximately U-shape having an engaging groove 72A1 opened to the left side when viewed from the axial direction of the rotary shaft 70. The base end (lower end) of the hook portion 72A is connected with the upper part of the outer shaft portion 70B. In addition, the engaging groove 72A1 is curved in an approximately arc shape around the axial center of the rotary shaft 70 when viewed from the axial direction of the rotary shaft 70. The dimension in the width direction of the engaging groove 72A1 is approximately same as the dimension in the diameter of the striker 64. The body portion 64A of the striker 64 is inserted into the engaging groove 72A. Thus, the body portion 64A and the hook portion 72A are vertically engaged with each other. The above described position of the needle plate fixing unit 68 (rotary shaft 70 and cam hook 72) is shown in FIG. 6A and hereafter referred to as "engaged position." The state of the needle plate 60 and the needle plate fixing unit 68 in the engaged position is referred to as "fixed state." Consequently, in the fixed state of the needle plate fixing unit 68, the vertical movement of the striker 64 is limited and the needle plate 60 is fixed by the cam hook 72.

When the rotary shaft 70 is rotated from the engaged position to one of the rotation directions (direction of Arrow A in FIG. 6A) by the switching mechanism 74 which will be explained later, the engaged state between the body portion 64A of the striker 64 and the hook portion 72A is released and the fixed state of the needle plate 60 fixed by the cam hook 72 is released. The above described position of the needle plate fixing unit 68 (rotary shaft 70 and cam hook 72) is shown in FIG. 6B and hereafter referred to as "release position."

The cam portion 72B is extended to the left side from the base end (lower end) of the hook portion 72A. Specifically, the cam portion 72B is inclined downward and projected upward and leftward when viewed from the axial direction of the rotary shaft 70 toward the left side. In addition, the upper surface of the cam portion 72B is formed as a cam face 72B1. The distance from the axial center of the rotary shaft 70 to the cam face 72B1 is specified to become gradually longer from the base end to the tip end of the cam face 72B1. Furthermore, the cam face 72B1 is smoothly connected with the inner peripheral surface of the engaging groove 72A1 of the hook portion 72A.

When the rotary shaft 70 is rotated from the engaged position to one of the rotation directions by the switching mechanism 74 which will be explained later, after the engaged state between the engaging groove 72A1 of the hook portion 72A and the body portion 64A of the striker 64 is released, the cam face 72B1 of the cam portion 72B is specified to be in contact with the outer peripheral surface of the lower part of the body portion 64A of the striker 64. Consequently, when the rotary shaft 70 is further rotated from the release position to one of the rotation directions, the cam portion 72B (cam face 72B1) pushes the striker 64 upward and the right end of the needle plate 60 is pushed upward with respect to the bed part 16. The above described position of the needle plate fixing unit 68 (rotary shaft 70 and cam hook 72) is shown in FIG. 6C and hereafter referred to as "push-up position." In the position of the needle plate fixing unit 68 (rotary shaft 70 and cam hook 72), the position between the release position and the push-up position is "disengaged position" of the present invention. Namely, "disengaged position" of the present invention has a predetermined range in a circumferential direction of the rotary shaft 70. The state of the needle plate 60 and the needle plate fixing unit 68 in the position between the release position and the push-up position is referred to as "unfixed state."

<About Switching Mechanism>

The switching mechanism 74 is formed as a mechanism of switching the needle plate fixing unit 68 to the fixed state or to the unfixed state. The switching mechanism 74 includes a base plate 76, a needle plate motor 78 which functions as "driving unit", a transmission mechanism 80 and a link mechanism 86.

[About Base Plate]

The base plate 76 is formed in an approximately rectangular plate shape extending in the front-rear direction so that the plate thickness direction is aligned with the up-down direction. The base plate 76 is arranged on the right side of the rotary shaft 70 to be separately from the rotary shaft 70. The rear end of the base plate 76 is fixed to the skeleton frame. An exposure hole 76A having a circular shape is penetratingly formed on the front part of the base plate 76 at an approximately center in the left-right direction for exposing the later described output shaft 78A of the needle plate motor 78. In addition, a support shaft 76S is provided on the rear end of the base plate 76 for rotatably supporting the later described oscillating arm 84 of the transmission mechanism 80. The support shaft 76S is formed in an approximately cylindrical shape so that the axial direction of the support shaft 76S is aligned with the up-down direction. The support shaft 76S is projected upward from the base plate 76.

[About Needle Plate Motor]

The needle plate motor 78 is arranged adjacent to the lower side of the front part of the base plate 76 so that the axial direction of the needle plate motor 78 is aligned with the up-down direction. The needle plate motor 78 is fixed to the base plate 76 at a position not shown in the figure. Specifically, the needle plate motor 78 is arranged coaxially with the exposure hole 76A of the base plate 76. The output shaft 78A of the needle plate motor 78 is arranged in the exposure hole 76A. In addition, a pinion gear 82 forming the later described transmission mechanism 80 is provided on the output shaft 78A so as to be integrally rotated with the output shaft 78A. The pinion gear 82 is arranged on an upper side of the base plate 76. In the present embodiment, the needle plate motor 78 is formed as a stepping motor and electrically connected with the controller 94 which will be explained later. The needle plate motor 78 is operated by the control of the controller 94.

[About Transmission Mechanism]

The transmission mechanism 80 includes the above described pinion gear 82 and oscillating arm 84.

The oscillating arm 84 is formed in an approximately sector plate shape when viewed from above so that the plate thickness direction is aligned with the up-down direction. The oscillating arm 84 is arranged on the upper side of the base plate 76. A support boss 84A is formed on the base end (rear end) of the oscillating arm 84. The support boss 84A is formed in an approximately cylindrical shape so that the axial direction of the support boss 84A is aligned with the up-down direction. The support shaft 76S of the base plate 76 is inserted into the support boss 84A so as to be relatively rotative. Consequently, the oscillating arm 84 is rotatably supported by the support shaft 76S. Note that an E-ring ER is locked to the tip portion (upper end) of the support shaft 76S. The oscillating arm 84 is restricted from moving upward by the E-ring ER.

A rack portion 84B is formed on the tip portion (front end) of the oscillating arm 84. The rack portion 84B is curved in an approximately arc shape around the axial center of the support boss 84A (support shaft 76S) when viewed from above. The rack portion 84B is arranged on the rear side of the pinion gear 82 of the needle plate motor 78. In addition, a plurality of rack teeth is formed on the rack portion 84B.

The rack teeth are engaged with the pinion gear 82. Consequently, when the needle plate motor 78 is operated, the oscillating arm 84 swings (rotates) around the axis of the support shaft 76S. Specifically, the oscillating arm 84 reciprocally swings (rotates) between "first position" shown in a solid line and "second position" shown in a two-dot chain line in FIG. 1.

Furthermore, a connecting pin 84P is provided on the tip end side of the oscillating arm 84. The connecting pin 84P is formed in an approximately cylindrical shape so that the axial direction of the connecting pin 84P is aligned with the up-down direction. The connecting pin 84P is projected upward from the oscillating arm 84.

[About Link Mechanism]

The link mechanism 86 includes a first link 88 formed integrally with the front end of the rotary shaft 70 (outer shaft portion 70B) and a second link 90. The first link 88 is formed in a plate shape so that the plate thickness direction is aligned with the front-rear direction. The first link 88 is extended obliquely leftward and downward from the front end of the outer shaft portion 70B when viewed from the front.

The second link 90 is formed in an approximately long plate shape extending in the left-right direction. Specifically, the second link 90 includes a link portion 90L which forms the left part of the second link 90 and a link portion 90R which forms the right part of the second link 90. The link portion 90L is arranged adjacent to the rear side of the first link 88 so that the plate thickness direction is aligned with the front-rear direction. The left end of the link portion 90L (one end in the longitudinal direction of the second link 90) is rotatably connected with the tip portion of the first link 88 by a connecting pin P so that the axial direction of the connecting pin P is aligned with the front-rear direction.

The link portion 90R is arranged on the rear side of the link portion 90L so that the plate thickness direction is aligned with the up-down direction. The front end of the left end of the link portion 90R is connected with the upper end of the right end of the link portion 90L. Consequently, the link portion 90R is arranged on the upper side of the link portion 90L. The right end of the link portion 90R (the other end in the longitudinal direction of the second link 90) is rotatably connected with the connecting pin 84P of the oscillating arm 84.

Consequently, interlocked with the reciprocating swing of the oscillating arm 84, the second link 90 reciprocally moves in the front-rear direction and the first link 88 (i.e., rotary shaft 70) reciprocally rotates around the axis of the rotary shaft 70. Specifically, the rotary shaft 70 is arranged at the non-release position when the oscillating arm 84 is in the first position, and the rotary shaft 70 is shifted to the push-up position via the release position when the oscillating arm 84 swings from the first position to the second position.

<About Upper Shaft Phase Sensor>

As shown in FIG. 3, the upper shaft phase sensor 92 is provided on an intermediate portion in the longitudinal direction of the upper shaft 26. The upper shaft phase sensor 92 is formed as a sensor for detecting a rotation phase of the upper shaft 26. In the present embodiment, the upper shaft phase sensor 92 is formed as a rotary encoder as an example. Specifically, the upper shaft phase sensor 92 includes a rotary plate 92A and a phase detector 92B.

The rotary plate 92A has a circular disk shape. The rotary plate 92A is arranged coaxially with the upper shaft 26 and fixed to the upper shaft 26 so as to be integrally rotated with the upper shaft 26. A plurality of slits extending in the radial direction of the rotary plate 92A is penetratingly formed on the rotary plate 92A. The slits are arranged at predetermined intervals in the circumferential direction of the rotary plate 92A.

The phase detector 92B has a light emitting element and a light receiving element although they are not illustrated. The light emitting element and the light receiving element are arranged on the rotary plate 92A opposing to each other in the plate thickness direction. The rotary plate 92A is arranged between the light emitting element and the light receiving element. In addition, the phase detector 92B is electrically connected with the controller 94 which will be explained later (shown in FIG. 4A). The light emitting element emits light toward the rotary plate 92A, and the light receiving element receives the light passing through the slits of the rotary plate 92A. Thus, the upper shaft phase sensor 92 detects the rotation angle (phase) of the upper shaft 26 and outputs the detection signals to the controller 94.

<About Controller>

As shown in FIG. 4A, the above described sewing machine motor 22, operation part 24, needle plate motor 78 and upper shaft phase sensor 92 are electrically connected with the controller 94. The controller 94 controls operations of the sewing machine motor 22 and the needle plate motor 78 (switching mechanism 74) based on the operation signals outputted from the operation part 24.

Furthermore, the controller 94 has a determination unit 96. The determination unit 96 determines to allow or prohibit the operations of the needle plate motor 78 and the controller 94 controls the operations of the needle plate motor 78 based on the judgement of the determination unit 96. Specifically, the determination unit 96 determines to allow and prohibit the operations of the needle plate motor 78 based on the phase state of the upper shaft 26 (i.e., vertical positon of the needle 36) and the driving state of the sewing machine 10.

For more detail, when the sewing machine 10 is driven by the sewing machine motor 22 (i.e., in a motor driving state), the determination unit 96 determines to prohibit the operations of the needle plate motor 78. Namely, in the motor driving state of the sewing machine 10, the switching mechanism 74 is prevented from switching the needle plate fixing unit 68 from the fixed state to the unfixed state.

In addition, the determination unit 96 judges whether the rotation phase of the upper shaft 26 is the release phase or the non-release phase based on the detection signals detected by the upper shaft phase sensor 92. In other words, the determination unit 96 judges whether or not the needle tip of the needle 36 is positioned below the upper surface of the needle plate 60. When the sewing machine 10 is not driven by the motor (i.e., in a non-driving state of the sewing machine motor 22) and the phase of the upper shaft 26 is the non-release phase, the determination unit 96 determines to prohibit the operations of the needle plate motor 78. Namely, the needle plate motor 78 is operated interlockingly with the upper shaft phase sensor 92. When the sewing machine 10 is not in the motor driving state and the phase of the upper shaft 26 is in the non-release phase, the switching mechanism 74 is prevented from switching the needle plate fixing unit 68 from the fixed state to the unfixed state.

On the other hand, when the sewing machine 10 is not in the motor driving state and the phase of the upper shaft 26 is in the release phase, the determination unit 96 determines to allow the operations of the needle plate motor 78. When the determination unit 96 determines to allow the operations of the needle plate motor 78, the controller 94 operates the needle plate motor 78 based on the operation signals (operation signals for operating the needle plate motor 78) transmitted from the operation part 24.

(Operations and Effects)

Figure 5:
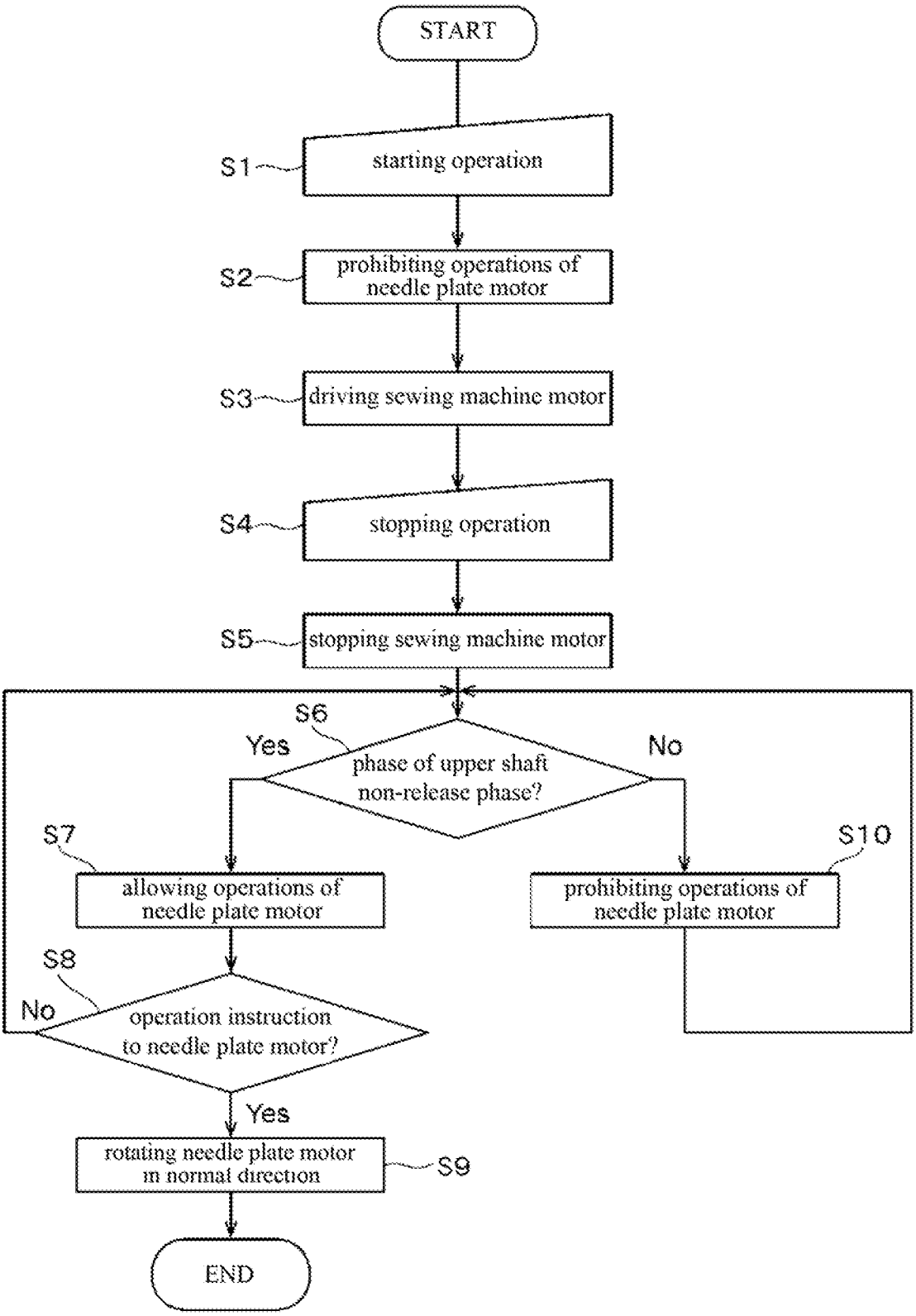
FIG. 5 is an operation flow of the needle plate detachable mechanism of the present embodiment.

Next, operations of the needle plate detachable mechanism 66 will be explained with reference to a flowchart shown in FIG. 5.

In the fixed state of the needle plate fixing unit 68 of the needle plate detachable mechanism 66, the rotary shaft 70 of the needle plate detachable mechanism 66 is arranged on the engaged position (shown in FIG. 6A) and the striker 64 of the needle plate 60 is engaged with the hook portion 72A of the cam hook 72. Consequently, the needle plate 60 is fixed to the bed part 16. In the above described state, in order to start driving the sewing machine 10, the operator performs touch operation on the icons displayed on the operation part 24 (Step S1). Consequently, the operation signals are outputted from the operation part 24 to the controller 94 and the sewing machine 10 is shifted to the motor driving state (driven by the sewing machine motor 22). Therefore, the determination unit 96 of the controller 94 determines to prohibit the operations of the needle plate motor 78 (Step S2). As a result, the switching mechanism 74 is prevented from switching the needle plate fixing unit 68 from the fixed state to the unfixed state. Thus, the fixed state of the needle plate fixing unit 68 is kept.

After the process of Step S2, the process shifts to Step S3 and the controller 94 starts driving the sewing machine motor 22. Consequently, the needle 36 is vertically moved between the top dead center and the bottom dead center to sew the sewing objects.

After the process of Step S3, in order to stop driving the sewing machine 10, the operator performs touch operation on the icons displayed on the operation part 24 (Step S4). As a result, the operation signals are outputted from the operation part 24 to the controller 94. The operation of the sewing machine motor 22 is stopped by the controller 94, which receives the operation signals from the operation part 24, and the sewing machine 10 is shifted from the motor driving state to the stop state (Step S5).

After the process of Step S5, the process shifts to Step S6 and the determination unit 96 of the controller 94 judges the phase state of the upper shaft 26 based on the detection signals of the upper shaft phase sensor 92. Specifically, the determination unit 96 judges whether or not the phase of the upper shaft 26 is the release phase. When the phase of the upper shaft 26 is the release phase (Yes in Step S6), the process shifts to Step S7. In Step S7, the determination unit 96 determines to allow the operations of the needle plate motor 78. Namely, the switching mechanism 74 is allowed to switch the needle plate fixing unit 68 from the fixed state to the unfixed state.

After the process of Step S7, the process shifts to Step S8. In Step S8, icons for urging the operation instruction to the needle plate motor 78 (switching mechanism 74) are displayed on the display part of the operation part 24 and the controller 94 judges whether or not the touch operation is performed on the icons of the operation part 24.

When the operation instruction to the needle plate motor 78 is performed in Step S8 (Yes in Step S8), the process shifts to Step S9. In Step S9, the controller 94 receives the operation signals from the operation part 24 and operates the needle plate motor 78 to rotate the output shaft 78A of the needle plate motor 78 in a normal direction. Consequently, the switching mechanism 74 switches the needle plate fixing unit 68 from the fixed state to the unfixed state. After the process of Step S9, the processes to the needle plate detachable mechanism 66 are finished.

In the process of Step S9, the output shaft 78A of the needle plate motor 78 is rotated together with the pinion gear 82 in a normal direction. Consequently, the oscillating arm 84 engaged with the pinion gear 82 swings from the first position to the second position. When the oscillating arm 84 swings from the first position to the second position, the second link 90 of the link mechanism 86 connected with the oscillating arm 84 is displaced leftward. Consequently, the first link 88 which is connected with the second link 90 so as to be relatively rotative is rotated in one of the rotation directions together with the rotary shaft 70. Namely, the rotary shaft 70 is rotated in one of the rotation directions (direction of Arrow A in FIG. 6A) from the engaged position.

As shown in FIG. 6B, when the rotary shaft 70 is rotated in one of the rotation directions from the engaged position, the body portion 64A of the striker 64 comes out from the engaging groove 72A1 of the hook portion 72A. Thus, the engaged state between the hook portion 72A and the striker 64 is released.

When the rotary shaft 70 is further rotated in one of the rotation directions from the above described state, the cam face 72B1 of the cam portion 72B abuts with the outer periphery of the lower part of the body portion 64A of the striker 64. Specifically, the cam face 72B1 slides on the outer peripheral surface of the body portion 64A while the contact part between the cam face 72B1 and the striker 64 is changed from the base end to the tip end of the cam face 72B1. Here, the distance from the axial center of the rotary shaft 70 to the cam face 72B1 is specified to become gradually longer from the base end to the tip end of the cam face 72B1. Therefore, when the rotary shaft 70 is rotated, together with the needle plate 60, the striker 64 is pushed upward by the cam face 72B1. As shown in FIG. 6C, when the rotary shaft 70 reaches the push-up position, the striker 64 is in contact with the tip end of the cam face 72B1. Thus, the needle plate 60 is pushed upward with respect to the bed part 16. Consequently, the needle plate 60 can be detached from the bed part 16.

On the other hand, when the operation instruction to the needle plate motor 78 is not performed in Step S8 (No in Step S8), the process returns to Step S6 and the determination unit 96 judges the phase state of the upper shaft 26 based on the detection signal transmitted from the upper shaft phase sensor 92. Namely, after the sewing machine motor 22 is stopped, the operator may sew the sewing objects with manual operation by operating the flywheel 29 without detaching (replacing) the needle plate 60. Therefore, when the operation instruction to the needle plate motor 78 is not performed in Step S8, the process returns to Step S6 and the determination unit 96 makes judgement based on the rotation phase of the upper shaft 26.

In Step S6, when the phase of the upper shaft 26 is the non-release phase (No in Step S6), the process shifts to Step S10. In Step S10, the determination unit 96 determines to prohibit the operation of the needle plate motor 78. As a result, the icons for urging the operation instruction to the needle plate motor 78 (switching mechanism 74) are not displayed on the operation part 24 (or the icons are displayed in an inoperable state). Thus, the operation instruction to the needle plate motor 78 is disabled. Namely, the switching mechanism 74 is prevented from switching the needle plate fixing unit 68 from the fixed state to the unfixed state. Thus, the fixed state of the needle plate fixing unit 68 is kept. After the process of Step S10, the process returns to Step S6 and the determination unit 96 repeats the judgement based on the rotation phase of the upper shaft 26.

In order to attach (fix) the needle plate 60 to the bed part 16 again, the needle plate 60 is placed on the cam face 72B1 in the unfixed state as shown in FIG. 6C. When the operator performs the operation instruction to the needle plate motor 78 by the operation part 24, the needle plate 60 is attached (fixed) to the bed part 16.

Namely, in the state shown in FIG. 6C, the needle plate motor 78 is operated by the controller 94 so that the output shaft 78A of the needle plate motor 78 is rotated in a reverse direction. Consequently, the rotary shaft 70 is rotated in the other of the rotation directions (direction of Arrow B in FIG. 6C) from the push-up position and shifted to the engaged position via the release position. When the rotary shaft 70 is rotated to the engaged position, the striker 64 is inserted into the engaging groove 72A1 of the hook portion 72A. Thus, the striker 64 and the cam hook 72 are vertically engaged with each other. As a result, the needle plate fixing unit 68 is switched from the unfixed state to the fixed state by the switching mechanism 74 and the needle plate 60 is fixed to the bed part 16 again.

Hereafter, the operation of the needle plate detachable mechanism 66 explained with reference to the above described flowchart will be further explained with reference to the timing chart shown in FIG. 7. In the timing chart of FIG. 7, (1) indicates the driving state of the sewing machine 10 and (2) indicates the operation state of the sewing machine motor 22. In addition, in the timing chart of FIG. 7, (3) indicates the phase state of the upper shaft 26 and (4) indicates the judgement state of the determination unit 96 with respect to the needle plate motor 78.

In the stop state (shown as stage "a" in FIG. 7) of the sewing machine 10, the sewing machine motor 22 is in the non-operation state (OFF state). At that time, the phase of the upper shaft 26 is the release phase, and the needle 36 is positioned above the needle plate 60. Therefore, the determination unit 96 determines to allow the operation of the needle plate motor 78. Namely, the switching mechanism 74 is allowed to switch the needle plate fixing unit 68 from the fixed state to the unfixed state.

Figure 7:
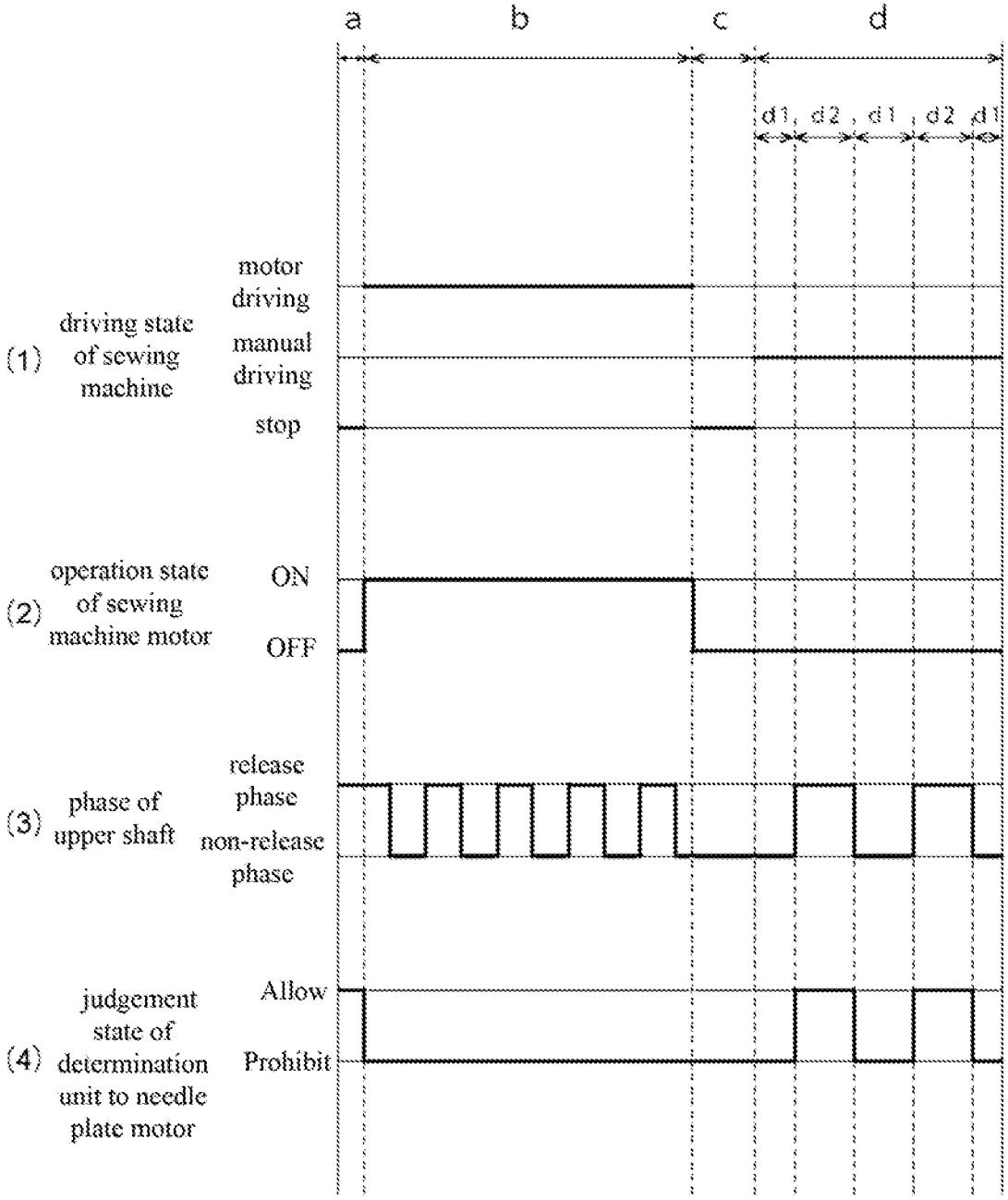
FIG. 7 is a timing chart of the needle plate detachable mechanism of the present embodiment.

In the stop state of the sewing machine 10, when the operator operates the operation part 24 to start driving the sewing machine 10, the sewing machine 10 is shifted from the stop state to the motor driving state (shown as stage "b" in FIG. 7). Therefore, the sewing machine motor 22 is operated by the controller 94 and shifted from the non-operation state (OFF state) to the operation state (ON state). Consequently, the upper shaft 26 is rotated and the needle 36 is vertically moved. Thus, the phase of the upper shaft 26 is repeatedly changed between the release phase and the non-release phase. In the above described state, the determination unit 96 determines to prohibit the operation of the needle plate motor 78. Thus, the switching mechanism 74 is prevented from switching the needle plate fixing unit 68 from the fixed state to the unfixed state.

From the above described state, when the operator operates the operation part 24 to shift the sewing machine 10 from the motor driving state to the stop state (shown as stage "c" in FIG. 7), the operation of the sewing machine motor 22 is stopped by the controller 94. Thus, the sewing machine motor 22 is shifted from the operation state (ON state) to the non-operation state (OFF state). In the example shown in FIG. 7, when the driving of the sewing machine 10 is stopped, the phase of the upper shaft 26 is the non-release phase. Therefore, the determination unit 96 determines to prohibit the operation of the needle plate motor 78. Thus, the switching mechanism 74 is prevented from switching the needle plate fixing unit 68 from the fixed state to the unfixed state.

From the above described state, when the operator manually operates the sewing machine 10 by using the flywheel 29 of the sewing machine 10, the sewing machine 10 is shifted from the stop state to the manual driving state (shown as stage "d" in FIG. 7). In the above described state, the non-operation state of the sewing machine motor 22 is kept. In addition, since the upper shaft 26 is rotated in the manual operation, the phase of the upper shaft 26 is changed between the non-release phase (shown as stage "d1" in FIG. 7) and the release phase (shown as stage "d2" in FIG. 7) alternately and repeatedly. Consequently, when the phase of the upper shaft 26 is the release phase, the determination unit 96 determines to allow the operation of the needle plate motor 78. Therefore, when the operator operates the operation part 24 to drive the needle plate motor 78, the controller 94 receives the operation signals from the operation part 24 and the needle plate motor 78 is operated. Consequently, the fixed state of the needle plate 60 is released.

On the other hand, when the phase of the upper shaft 26 is the non-release phase, the determination unit 96 determines to prohibit the operation of the needle plate motor 78. Therefore, the non-operation state of the needle plate motor 78 is kept and the fixed state of the needle plate 60 is kept.

As explained above, in the needle plate detachable mechanism 66 of the present embodiment, when the sewing machine motor 22 is not driven and (the needle tip of) the needle 36 is positioned below the upper surface of the needle plate 60, the switching mechanism 74 is prevented from switching the needle plate fixing unit 68 from the fixed state to the unfixed state. When the needle 36 is positioned below the upper surface of the needle plate 60, the needle 36 is inserted into the needle hole 60A of the needle plate 60. Therefore, if the switching mechanism 74 is operated in this state, the fixed state of the needle plate 60 is released while the needle 36 is inserted into the needle hole 60A of the needle plate 60. Thus, the above described situation is not suitable for replacing the needle plate 60. Consequently, the replacement of the needle plate 60 can be prevented in the situation not suitable for replacing the needle plate 60 by prohibiting the detachment of the needle plate 60 from the bed part 16.

In addition, when the sewing machine motor 22 is driven, the switching mechanism 74 is prevented from switching the needle plate fixing unit 68 from the fixed state to the unfixed state. When the sewing machine motor 22 is driven, the operator sews sewing objects. Therefore, the operator has no intention to replace the needle plate 60 in the above described situation. Consequently, the above described situation is also not suitable for replacing the needle plate 60. Thus, in the above described situation not suitable for replacing the needle plate 60, the needle plate 60 is prevented from being detached from the bed part 16. Thus, the replacement of the needle plate 60 can be prevented. As explained above, in the situation not suitable for replacing the needle plate 60, the replacement of the needle plate 60 can be prevented.

In addition, the needle plate fixing unit 68 of the needle plate detachable mechanism 66 includes the rotary shaft 70 and the cam hook 72 which is integrally rotatable with the rotary shaft 70. Since the cam hook 72 is arranged on the engaged position, the hook portion 72A of the cam hook 72 is engaged with the striker 64 of the needle plate 60. Thus, the needle plate fixing unit 68 is shifted to the fixed state. On the other hand, when the cam hook 72 is rotated from the engaged position to the push-up position (release position), the engaged state between the hook portion 72A of the cam hook 72 and the striker 64 of the needle plate 60 is released. Thus, the needle plate fixing unit 68 is shifted to the unfixed state. Namely, the needle plate 60 can be switched to the fixed state or the unfixed state by rotating the needle plate fixing unit 68 around the axis of the rotary shaft 70 to engage/disengage the hook portion 72A of the cam hook 72 with/from the needle plate 60 (striker 64). Therefore, the needle plate 60 can be switched to the fixed state or the unfixed state by a simpler structure compared to the needle plate detachable mechanism described in the prior art (i.e., the structure formed by separate members: an engaging member provided on the sewing machine body side for fixing the needle plate; and an operation lever/push-up bar for releasing the fixed state of the needle plate).

In addition, the cam hook 72 has the cam portion 72B. When the cam hook 72 is rotated from the engaged position to the push-up position together with the rotary shaft 70, the hook portion 72A of the cam hook 72 is disengaged from the striker 64 of the needle plate 60 and then the striker 64 (needle plate 60) is pushed upward by the cam portion 72B. Consequently, the needle plate 60 of the unfixed state can be easily detached from the bed part 16. Accordingly, convenience for replacing the needle plate 60 can be improved.

In addition, as explained above, when the needle plate 60 is fixed to the bed part 16, the needle plate 60 is placed on the cam portion 72B which is arranged on the push-up position and the switching mechanism 74 is switched from the unfixed state to the fixed state. Thus, the needle plate 60 can be automatically fixed to the bed part 16. Consequently, convenience of the operator can be improved when attaching (fixing) the needle plate 60 to the bed part 16.

In addition, as explained above, in the cam hook 72 of the needle plate fixing unit 68, the hook portion 72A for engaging with the striker 64 and the cam portion 72B for pushing up the striker 64 are arranged on the same (corresponding) position in the axial direction of the rotary shaft 70. Therefore, a space of the cam hook 72 can be saved compared to the structure where the hook portion 72A and the cam portion 72B are displaced in the axial direction of the rotary shaft 70.

In addition, the engaging groove 72A1 of the hook portion 72A is curved in an arc shape around the axial center of the rotary shaft 70 when viewed from the axial direction of the rotary shaft 70. Therefore, even if the rotary shaft 70 is displaced in the circumferential direction in the engaged position of the rotary shaft 70, the engaged state between the hook portion 72A (engaging groove 72A1) and the striker 64 (body portion 64A) can be kept. Consequently, the displacement of the rotary shaft 70 in the circumferential direction can be absorbed by the engaging groove 72A1 and the engaged state between the hook portion 72A (engaging groove 72A1) and the striker 64 (body portion 64A) can be kept. In addition, since the displacement of the rotary shaft 70 in the circumferential direction is absorbed by the engaging groove 72A1, it is not required to constantly keep the rotary shaft 70 in the engaged position by supplying electrical power to the needle plate motor 78, for example. Consequently, power consumption of the sewing machine 10 can be reduced.

In addition, the needle plate detachable mechanism 66 has the upper shaft phase sensor 92. The upper shaft phase sensor 92 detects the rotation phase of the upper shaft 26 which vertically moves the needle 36. Therefore, since the rotation phase (angle) of the upper shaft 26 is detected by the upper shaft phase sensor 92, the vertical position of the needle 36 can be easily detected. Thus, the vertical position of the needle 36 can be detected by a simple configuration in the needle plate detachable mechanism 66.

In addition, the rotary shaft 70 includes the core portion 70A made of metal to form an axial center of the rotary shaft 70 and the outer shaft portion 70B made of resin to form an outer periphery of the rotary shaft 70. The cam hook 72 is integrally formed with the outer shaft portion 70B. Therefore, the rotary shaft 70 having the cam hook 72 can be manufactured at low cost while the strength of the rotary shaft 70 is kept.

In addition, if the outer shaft portion 70B is formed by a material (POM) having a relatively good sliding property, for example, the cam face 72B1 is slid well on the needle plate 60 when the rotary shaft 70 is rotated. Thus, the needle plate 60 can be pushed up to the upper side by the cam portion 72B.

Furthermore, since the outer shaft portion 70B is made of resin, generation of abnormal noise can be suppressed when the cam face 72B1 slides on the lower surface of the needle plate 60.

In addition, the operation dial 70D is provided on the rear end of the rotary shaft 70 so as to be integrally rotated with the rotary shaft 70. The operation dial 70D is exposed outside the cover 50 so as to be operable. Therefore, when the operation dial 70D is rotationally operated, the fixed state of the needle plate 60 can be released by manually rotating the rotary shaft 70. Consequently, the needle plate 60 can be removed from the bed part 16 in an emergency, for example, when the needle plate motor 78 is broken.

In addition, the switching mechanism 74 includes the link mechanism 86 which is connected with the rotary shaft 70 and the transmission mechanism 80 which transmits a driving force of the needle plate motor 78 to the link mechanism 86. Consequently, the driving force of the needle plate motor 78 is transmitted to the link mechanism 86 and the rotary shaft 70 can be rotated between the engaged position and the push-up position. In addition, by using the link mechanism 86, the needle plate motor 78 can be installed in an arbitrary position in the bed part 16 which is separated from the rotary shaft 70.

In addition, the transmission mechanism 80 of the switching mechanism 74 includes the pinion gear 82 which is provided on the output shaft 78A of the needle plate motor 78 so as to be integrally rotated and the oscillating arm 84 having the rack portion 84B engaged with the pinion gear 82. The second link 90 of the link mechanism 86 is connected with the oscillating arm 84 so as to be relatively rotative. Consequently, the rotative force of the needle plate motor 78 is converted into linear motion and the rotary shaft 70 can be reciprocally rotated by the link mechanism 86 by a simple configuration.

Although the cam portion 72B (cam face 72B1) of the cam hook 72 slides on the striker 64 to push up the needle plate 60 in the present embodiment, the configuration for pushing up the needle plate 60 is not limited to the above described configuration. For example, a push-up pin having a bar shape projecting outward in the radial direction of the rotary shaft 70 can be formed on the rotary shaft 70 instead of the cam portion 72B. In the above described case, a tip end of the push-up pin abuts with the lower surface of the needle plate 60 when rotating the rotary shaft 70 to push up the needle plate 60 by the tip end.

Although the rotary shaft 70 is formed by the core portion 70A made of metal and the outer shaft portion 70B made of resin in the present embodiment, the configuration of the rotary shaft 70 is not limited to the above described configuration. For example, entire the rotary shaft 70 can be made of metal or resin.

Although the operation dial 70D is formed on the rear end of the rotary shaft 70 so as to be integrally rotated in the present embodiment, the operation dial 70D can be omitted in the rotary shaft 70. In the above described case, the rotary shaft 70 can be formed in a long cylindrical shape to rotatably support the rotary shaft 70 by the support shaft fixed to the skeleton frame, for example.

Although the switching mechanism 74 includes the transmission mechanism 80 and the link mechanism 86 in the present embodiment, the transmission mechanism 80 and the link mechanism 86 can be omitted in the switching mechanism 74. In the above described case, the needle plate motor 78 can be arranged so that the axial direction of the needle plate motor 78 is aligned with the front-rear direction to fix the rotary shaft 70 to the output shaft 78A of the needle plate motor 78 so as to be integrally rotated, for example.

In addition, the operation part 24 of the sewing machine 10 is formed as the operation part including the display part and the touch panel in the present embodiment. Instead of the above described configuration, the operation part 24 can be formed by a plurality of operation buttons exposed outside the sewing machine 10 so as to be operable. In the above described case, the controller 94 can be configured not to receive the operation signals from the operation part 24 when the sewing machine motor 22 is not driven and (the needle tip of) the needle 36 is positioned below the upper surface of the needle plate 60 or when the sewing machine motor 22 is driven even if the operation buttons are operated.

Note that, this invention is not limited to the above-mentioned embodiments. Although it is to those skilled in the art, the following are disclosed as the one embodiment of this invention.

Mutually substitutable members, configurations, etc. disclosed in the embodiment can be used with their combination altered appropriately.

Although not disclosed in the embodiment, members, configurations, etc. that belong to the known technology and can be substituted with the members, the configurations, etc. disclosed in the embodiment can be appropriately substituted or are used by altering their combination.

Although not disclosed in the embodiment, members, configurations, etc. that those skilled in the art can consider as substitutions of the members, the configurations, etc. disclosed in the embodiment are substituted with the above mentioned appropriately or are used by altering its combination.

While the invention has been particularly shown and described with respect to preferred embodiments thereof, it should be understood by those skilled in the art that the foregoing and other changes in form and detail may be made therein without departing from the sprit and scope of the invention as defined in the appended claims.

What is claimed is:

1. A needle plate detachable mechanism of a sewing machine which forms a seam by vertically driving a needle by a driving force of a sewing machine motor, the needle plate detachable mechanism comprising:

a needle plate fixing unit capable of being switched between a fixed state where a needle plate is fixed to a sewing machine body and an unfixed state where the fixed state is released;

a switching mechanism which is connected with the needle plate fixing unit for switching the needle plate fixing unit between the fixed state and the unfixed state;

a detector for detecting a vertical position of the needle; and a controller which is electrically connected with the sewing machine motor, the detector and the switching mechanism to determine to allow and prohibit an operation of the switching mechanism, wherein the controller prohibits the operation of the switching mechanism when a needle tip of the needle is positioned below an upper surface of the needle plate based on the vertical position of the needle detected by the detector, and the controller prohibits the operation of the switching mechanism when the sewing machine motor is driven.

2. The needle plate detachable mechanism according to claim 1, wherein the needle plate fixing unit includes:

a rotary unit provided on the lower surface of the needle plate; and a needle plate engaging unit provided to be integrally rotatable with the rotary unit, wherein when the rotary unit is rotated, the needle plate engaging unit is rotated between an engaged position where the needle plate engaging unit is engaged with the needle plate and a disengaged position where the needle plate engaging unit is disengaged from the needle plate, and the needle plate fixing unit is switched between the fixed state and the unfixed state when the needle plate engaging unit is rotated between the engaged position and the disengaged position.

3. The needle plate detachable mechanism according to claim 2, wherein the needle plate engaging unit includes:

a hook portion which is engaged with the needle plate at the engaged position; and a push-up portion which pushes up the needle plate with respect to the sewing machine body at the disengaged position.

4. The needle plate detachable mechanism according to claim 2, wherein the switching mechanism includes a driving unit which is connected with the rotary unit for rotatably driving the rotary unit.

5. A sewing machine having the needle plate detachable mechanism of claim 1.

* * * * *